US008787121B2

(12) United States Patent
Nagahama

(10) Patent No.: US 8,787,121 B2
(45) Date of Patent: Jul. 22, 2014

(54) ELECTRONIC TIMEPIECE WITH SOLAR CELL

(71) Applicant: Seiko Epson Corporation, Tokyo (JP)

(72) Inventor: Reiko Nagahama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/708,130

(22) Filed: Dec. 7, 2012

(65) Prior Publication Data

US 2013/0148482 A1 Jun. 13, 2013

(30) Foreign Application Priority Data

Dec. 9, 2011 (JP) ..... 2011-269892

(51) Int. Cl.
*G04B 1/00* (2006.01)

(52) U.S. Cl.
USPC ..... 368/205

(58) Field of Classification Search
CPC ..... G04C 10/00; G04C 10/02; G04C 10/04; G04G 19/00; G04G 17/04; G04G 17/06
USPC ..... 368/205, 204, 228, 297, 299, 76, 80
See application file for complete search history.

(56) References Cited

U.S. PATENT DOCUMENTS

| | | | | |
|---|---|---|---|---|
| 6,791,905 | B1 * | 9/2004 | Sekiguchi | 368/80 |
| 6,901,033 | B2 * | 5/2005 | Ito | 368/204 |
| 7,400,556 | B2 * | 7/2008 | Osa et al. | 368/205 |
| 2011/0013491 | A1 * | 1/2011 | Fujisawa | 368/10 |

FOREIGN PATENT DOCUMENTS

| | | | |
|---|---|---|---|
| JP | 61-030790 | A | 2/1986 |
| JP | 2004-239714 | A | 8/2004 |
| JP | 2004-279252 | A | 10/2004 |
| JP | 2005-091179 | A | 4/2005 |

* cited by examiner

*Primary Examiner* — Edwin A. Leon
(74) *Attorney, Agent, or Firm* — Global IP Counselors, LLP

(57) ABSTRACT

To provide an electronic timepiece with a solar cell whereby a movement can be reduced in size and whereby a calendar function using a calendar wheel can be achieved, an electronic timepiece with a solar cell is provided with: a solar cell, a character plate, a ground plate arranged on a back surface of the solar cell, a ring-shaped date wheel arranged between the character plate and the ground plate, and a circuit board electrically connected to an electrode of the solar cell via a conduction spring. The conduction spring is arranged on the inside of the date wheel when in plan view seen from the character plate side. In comparison to a case where a conduction spring is provided to the outside of a date wheel, the movement can be reduced in size, and because the date wheel can be arranged, a calendar function can be achieved.

5 Claims, 5 Drawing Sheets

ELECTRONIC TIMEPIECE WITH SOLAR CELL

CROSS-REFERENCE TO RELATED APPLICATIONS

This application claims priority to Japanese Patent Application No. 2011-269892 filed on Dec. 9, 2011. The entire disclosure of Japanese Patent Application No. 2011-269892 is hereby incorporated herein by reference.

BACKGROUND

1. Technical Field

The present invention relates to an electronic timepiece with a solar cell.

2. Background Technology

In an electronic timepiece with a solar cell, to which a solar cell is provided, a conduction part where a conduction spring (a coil spring) is used is provided to an outer peripheral part of a movement, in order for a secondary battery or the like to be charged with power generated by the solar cell (for example, see FIG. 11 of Patent Citation 1).

When the conduction part is provided to the outer periphery of the movement, there is an inevitable increase in the size of the movement in comparison to an ordinary electronic timepiece driven by a primary battery. For this reason, a problem has emerged in that it is difficult to configure a smaller-sized electronic timepiece with a solar cell, especially one suitable for use by women. In view whereof, in FIG. 4 of Patent Citation 1, a solar cell connection spring is arranged in a spatial region enclosed by a trigger piece, the main body of a yoke, and a yoke return spring part.

Japanese Laid-open Patent Publication No. 2004-239714 (Patent Document 1) is an example of the related art.

SUMMARY

Problems to Be Solved by the Invention

However, as is illustrated in FIG. 4 of Patent Citation 1, a new problem emerges in that when the solar connection spring is arranged in the vicinity of the trigger piece and/or the yoke, then it is difficult to provide a calendar function. More specifically, the trigger piece and the yoke are disposed close to the winding stem. A date wheel or similar calendar wheel is disposed on an upper side of the winding stem, and a calendar window formed on a character plate displays calendar information. The calendar wheel is formed in a ring shape (an annular shape), and is arranged between the solar cell and the movement, and therefore there is interference between the solar connection spring and the arrangement position. For this reason, in Patent Citation 1, a problem emerges in that it is not possible to use the calendar wheel to achieve a calendar function.

An advantage of the invention is to provide an electronic timepiece with a solar cell whereby a movement can be reduced in size and whereby a calendar function using a calendar wheel can be achieved.

Means Used to Solve the Above-Mentioned Problems

The electronic timepiece with a solar cell of the invention includes: a solar cell; a light-transmissive character plate arranged on a timepiece front side of the solar cell; a ground plate arranged on a back surface of the solar cell; a ring-shaped calendar wheel disposed between the character plate and the ground plate; and a circuit board electrically connected to an electrode of the solar cell via a conduction spring, the conduction spring being arranged on the inside of the calendar wheel in plan view seen from the character plate side.

In the electronic timepiece with a solar cell of the invention, the conduction spring electrically connecting the electrode of the solar cell and the circuit board is arranged in a space on the inside of the ring-shaped calendar wheel, which is a date wheel or the like. For this reason, the movement can be reduced in size in comparison to a case where the conduction spring is provided to the outside of the calendar wheel. As such, an electronic timepiece with a solar cell for use by women can also be readily designed.

In the case where the conduction spring is provided to the outside of the calendar wheel, when a model in which the calendar wheel has a large outer diameter is to be designed, it becomes necessary to change the arrangement position of the conduction spring, and the electrode position of the solar cell must also be changed. By contrast, according to the invention, because there is no interference with the conduction spring even when the outer diameter dimension of the calendar display is increased, there is no need to change the electrode position of the solar cell or the arrangement position of the conduction spring when a model in which the calendar wheel has a large outer diameter is being developed as the electronic timepiece with a solar cell. For this reason, a movement that includes the solar cell, the conduction spring, the circuit board, and the like can be created to be shared among a variety of models in which the outer diameter dimension of the calendar wheel is different, and also costs can be reduced.

It is also possible to reduce the distance between the calendar wheel and the outer circumference of the timepiece (an outer casing) in comparison to the case where the conduction spring is provided to the outside of the calendar wheel. For this reason, the degree of freedom in the formation position of the calendar window for offering a view of the calendar wheel is improved, and the degree of freedom in the design variation of the character plate can be improved.

Preferably, the electronic timepiece with a solar cell of the invention includes a solar cell holding member fixed to the back surface of the solar cell, the solar cell holding member and the ground plate each having opposing surfaces provided to the inside of the calendar wheel in plan view seen from the character plate side, a hook part being formed on one of the opposing surfaces and a guide hole formed to allow for the hook part to be arranged being formed on the other of the opposing surfaces, and the solar cell holding member being rotated with respect to the ground plate in the state where the hook part has been arranged within the guide hole to lock a peripheral edge of the guide hole onto the hook part, whereby the solar cell holding member is fixed to the ground plate.

In the electronic timepiece with a solar cell of the invention, opposing surfaces provided to the inside of the calendar wheel in plan view seen from the character plate side are provided to the ground plate and to the solar cell holding member fixed to the back surface of the solar cell. The hook part is provided to one of the opposing surfaces and the guide hole is provided to the other. Because the hook part and the guide hole are formed on the opposing surfaces on the inside of the calendar wheel, the fixation position at which the solar cell and the solar cell holding member are fixed to the ground plate can be set so as to be close to the arrangement position of the conduction spring. For this reason, even when a pressing force is applied to the electrode of the solar cell by the conduction spring, the pressing force can be borne by a locking structure of the hook part and the guide hole. As such, the pressing force of the conduction spring can be prevented from majorly deforming the solar cell even in a case where the solar cell used is a film solar panel in which the base material is made of a plastic film.

Also, the solar cell holding member need not be projected out to the outer periphery of the solar cell, and will not be visible through the character plate. For this reason, there is no need to arrange a visual limiting member for covering the solar cell holding member, and any constraint of the visual limiting diameter can also be eliminated. Accordingly, the degree of freedom of the size of the character plate and of the visual limiting diameter can be increased, and in a case where the electronic timepiece with a solar cell is to be configured to be a wristwatch, then the degree of freedom of model variation can also be increased, from a large-sized wristwatch having a large visual limiting diameter to a wristwatch for use by women, having a small visual limiting diameter. In addition, because the solar cell can be fixed at the ground plate, i.e., in the vicinity of the center of the movement, the size of the solar cell can be freely set within the size of the movement. For this reason, the size of the solar cell can be set to a minimum size on the basis of the amount of power generation required even in a case where the size of the movement is different. As such, the size of the solar cell need not be increased in accordance with the size of the movement, and the cost of the solar cell can thus also be reduced.

Furthermore, because the solar cell holding member is rotated with the hook part arranged in the guide hole to lock the peripheral edge of the guide hole onto the hook part and thereby fix together the solar cell holding member and the ground plate, the need for a connecting component, such as a screw, for fixing same can be obviated. For this reason, in comparison to a case where the solar cell is fixed to the ground plate with a screw, the number of components can be lowered and costs can be reduced; because consideration also need not be given to interference with a component arranged on the back surface side of the ground plate, an electronic timepiece with a solar cell posing even less of a burden on the global environment can be easily designed.

In the electronic timepiece with a solar cell of the invention, preferably, the solar cell holding member includes a positioning part for engaging with a positioning projection formed in the ground plate to carry out positioning in the direction of rotation, as well as an insertion hole into which the conduction coil is inserted, and the positioning part and the insertion hole are arranged so as to be adjacent to each other.

Because the positioning projection formed on the ground plate and the positioning part provided to the solar cell holding member are engaged together, the solar cell holding member can be prevented from rotating with respect to the ground plate in a direction inverse to the direction of locking of the guide hole and the hook part and the peripheral edge of the guide hole can be prevented from disengaging from the hook part.

Also, because the positioning part provided to the solar cell holding member and the insertion hole into which the conduction spring is inserted are arranged so as to be adjacent to each other, the solar cell holding member and the conduction spring can be more readily attached and detached. More specifically, when the solar cell holding member is to be mounted onto the ground plate, the solar cell holding member is placed atop the conduction spring arranged in the insertion hole and is pressed against the conduction spring, and also the peripheral edge of the guide hole is locked onto the hook part and the positioning part is engaged with the positioning projection while the solar cell holding member is being rotated.

When the positioning part is engaged with the positioning projection, because the positioning part is present near the conduction spring, the conduction spring can also be pushed in at the same time when the positioning part is being pushed in. As such, in comparison to a case where the positioning part and the conduction spring are arranged at positions spaced apart from each other, the solar cell holding member can be more easily mounted.

Also, when the positioning part of the solar cell holding member is to be removed from the positioning projection, too, then this can be done while the conduction spring near thereto is being pressed, and the solar cell holding member can also be easily removed.

In the electronic timepiece with a solar cell of the invention, preferably, the solar cell is arranged on the inside of the calendar wheel in plan view seen from the character plate side.

When the solar cell is arranged in the space on the inside of the calendar wheel, then the solar cell and the calendar wheel can be arranged at an identical height position in the thickness direction of the timepiece. For this reason, the thickness dimension of the movement can be reduced. Also, the surface area of the solar cell can be lowered, and therefore the costs of the solar cell can be reduced.

In the electronic timepiece with a solar cell of the invention, preferably, the height position of an upper surface of the calendar wheel in the thickness direction of the timepiece is positioned above a lower surface of the solar cell.

When the upper surface of the calendar wheel is set to be above the lower surface of the solar cell in terms of the height position in the thickness direction of the timepiece, the distance between the upper surface of the calendar wheel and the character plate arranged atop the solar cell can be lowered. For this reason, the impression of a recessed setting of the calendar wheel which can be viewed from the calendar window of the character plate can be attenuated, and the date and the like can also be more easily read.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the invention shall now be described with reference to the accompanying drawings.

Schematic Configuration of the Electronic Timepiece with a Solar Cell

Figure 1:
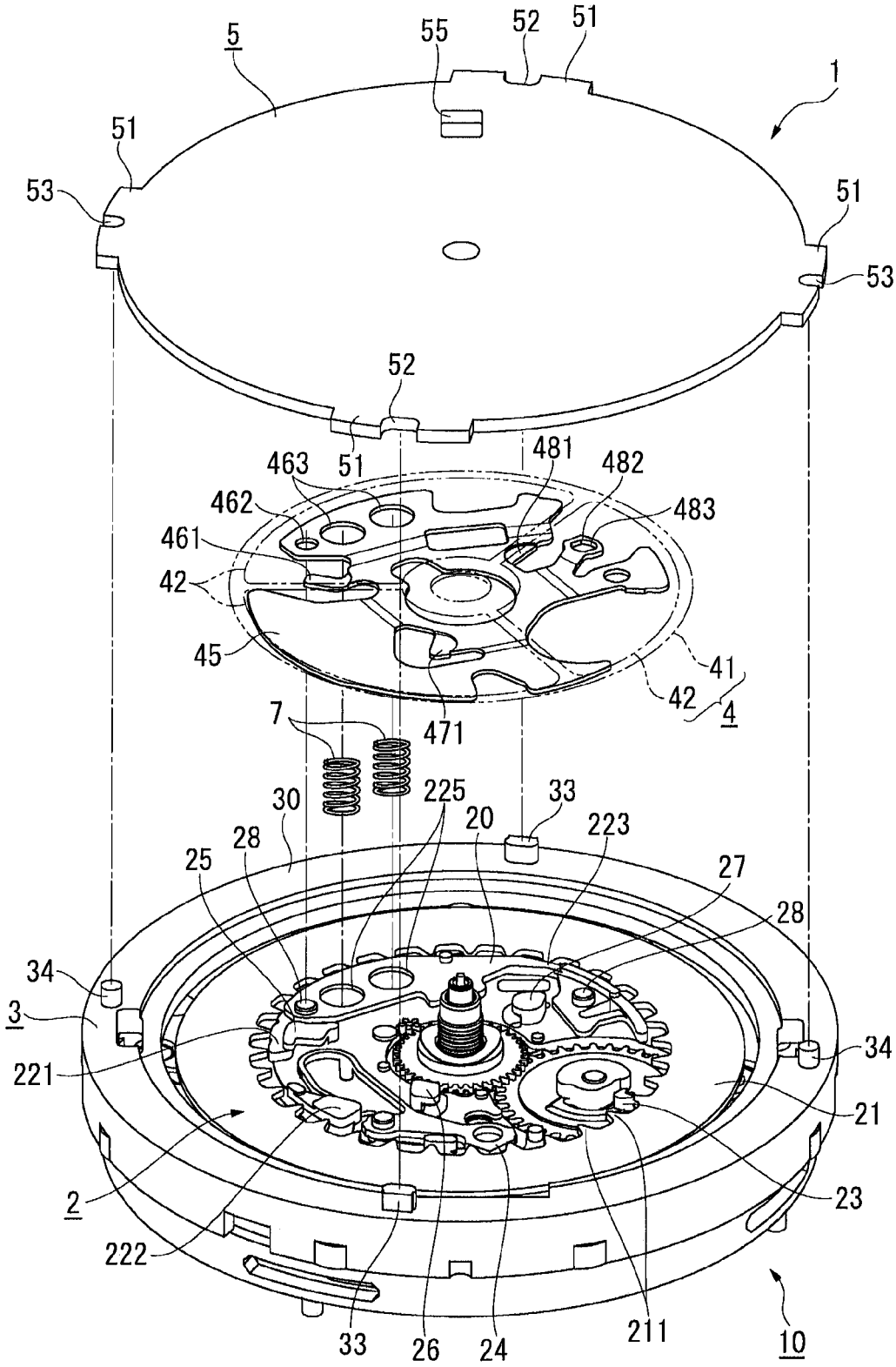
FIG. 1 is an exploded perspective view of an electronic timepiece with a solar cell according to an embodiment of the invention.

FIG. 1 is an exploded perspective view of a timepiece main body 10 of an electronic timepiece 1 with a solar cell according to the present embodiment. The electronic timepiece 1 with a solar cell is schematically constituted of the timepiece main body 10 as well as an outer case (not shown) for accommodating the timepiece main body 10, and is of a wristwatch type which a user utilizes worn on the wrist.

Configuration of the Timepiece Main Body

Figure 2:
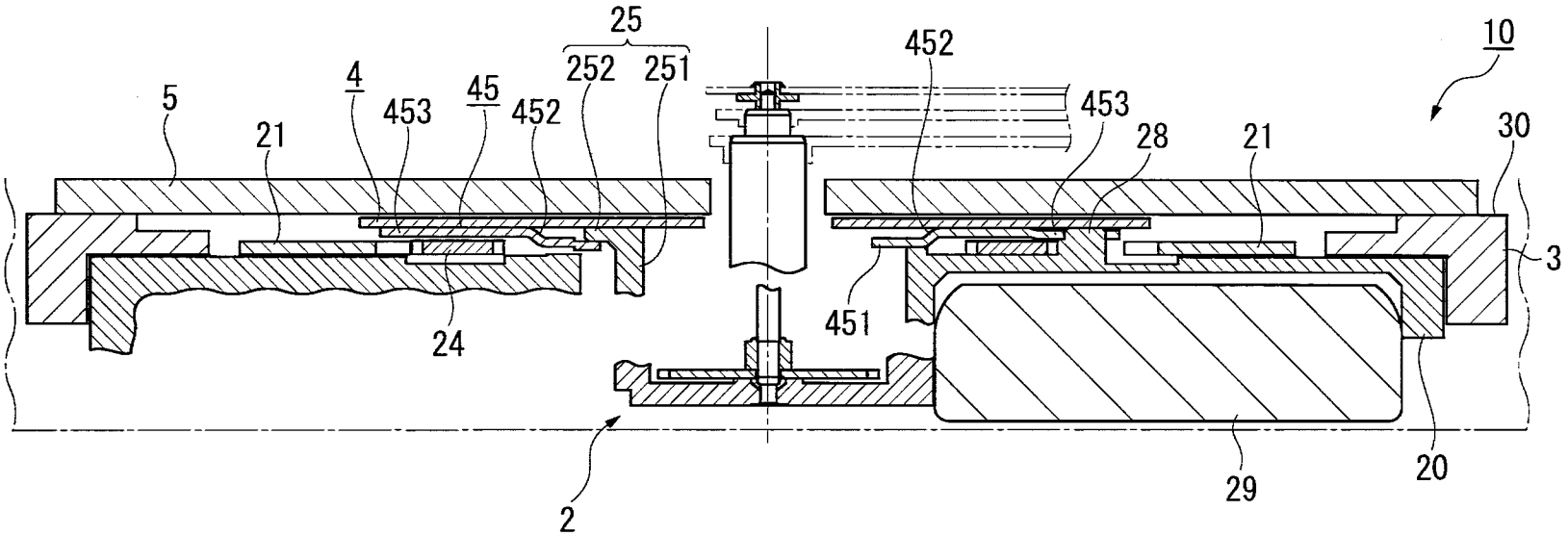
FIG. 2 is a vertical cross-sectional view illustrating the main parts of the electronic timepiece with a solar cell.

The timepiece main body 10, as illustrated in FIG. 1, is provided with a movement 2, a character plate-receiving ring member 3, a solar cell 4, and a light-transmissive character plate 5 arranged on the front side of the solar cell 4. The movement 2, as is also illustrated in FIG. 2, adopts a general configuration incorporating a ground plate 20, a circuit board, a stepping motor, a driving wheel train, and the like, and therefore a description thereof has been omitted. The outer case also has a general configuration, and a description thereof has thus also been omitted.

Configuration of the Ground Plate

A date wheel 21, which is a calendar wheel, is arranged on an upper surface of the ground plate 20. Drive teeth 211 are formed on an inner peripheral surface of the date wheel 21. Guide parts 221, 222, 223 for guiding the inner peripheral surface of the date wheel 21 (the drive teeth 211) are formed so as to project out on the ground plate 20. A date-turning wheel 23 which rotates in meshed engagement with the drive teeth 211 of the date wheel 21 and a day jumper 24 for regulating the position thereof after rotation when the date wheel 21 has been rotated one pitch by the date-turning wheel 23 are provided to an inner peripheral side of the date wheel 21 on the upper surface of the ground plate.

Three hook parts 25, 26, 27 for fixing the solar cell 4 are also formed on the inner peripheral side of the date wheel 21 on the upper surface of the ground plate 20. The hook part 25, as is also illustrated in FIG. 2, is provided so as to be adjacent to the guide part 221, and is provided with an upright part 251 standing upright from the ground plate 20 and with an extension part 252 extending to the side from the upright part 251. As such, a recess for locking the solar cell 4 is formed between the upper surface of the ground plate 20 and the extension part 252. The other hook parts 26, 27 are also configured to be provided with an upright part and an extension part similarly with respect to the hook part 25. Positioning projections 28 are provided projecting out at two locations on the guide part 223.

Also, as shall be described below, two insertion holes 225 into which a conduction spring 7 is to be inserted are formed at a position adjacent to the positioning projection 28 formed closer to the hook part 25 from among the two positioning projections 28 provided to the ground plate 20, i.e., are formed on the inner peripheral side of the date wheel 21.

Configuration of the Character Plate-Receiving Ring Member

The character plate-receiving ring member 3 is formed in an annular shape using a non-light-transmissive-material (for example, a synthetic resin), and is colored to be of the same type of color as the solar cell 4 described below. The character plate-receiving ring member 3 has a support hook part (not shown) formed at two mutually facing locations with the plane center thereof interposed therebetween. The support hook parts engage with a back surface side of the movement 2, and the character plate-receiving ring member 3 holds the movement 2.

An upper surface 30 of the character plate-receiving ring member 3 is provided with two first character plate fixing parts 33 arranged so as to be mutually facing with the center of the character plate-receiving ring member 3 interposed therebetween, and also with two second character plate fixing parts 34 also arranged so as to be mutually facing. The first character plate fixing parts 33 are constituted of a substantially prismatic-shaped engagement projection formed so as to project out toward the character plate 5 from the upper surface 30. The second character plate fixing parts 34 are constituted of a cylindrical-shaped engagement projection formed so as to project out toward the character plate 5 from the upper surface 30.

Configuration of the Solar Cell

The solar cell 4, as illustrated in FIG. 1, is provided with a base material 41 having a substantially cylindrical shape in plan view and a solar cell light-receiving unit 42 formed on a front surface side of the base material 41. The base material is constituted of an insulating material such as a film made of a synthetic resin. The light-receiving unit 42 is configured by stacking onto the front surface of the base material 41 a metal electrode layer, a semiconductor layer, an insulating layer, a wiring electrode layer, a light-transmissive sealing resin layer, or the like. The light-receiving unit 42 is formed separated into three regions. More specifically, three fan-shaped light-receiving units 42 are formed on the front surface of the solar cell 4. In the present embodiment, the generated electrical voltage is enhanced by connecting in series the outputs of the three light-receiving units 42.

Figure 3:
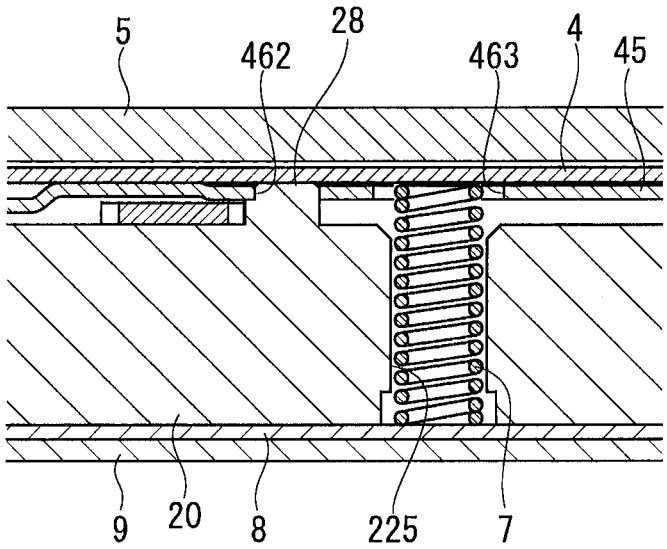
FIG. 3 is a vertical cross-sectional view illustrating an arrangement structure for a conduction spring.

Solar light transmitted through the character plate 5 hits against the light-receiving units 42, whereby the solar cell 4 generates electricity, and the power generated by the light-receiving units 42, as is also illustrated in FIG. 3, is charged in a secondary cell 29 provided to the movement via a conduction spring including a coil spring or the like; the circuit board and the like are driven by the output of the second cell 29. The solar cell 4 is set such that outer diameter dimension is of an equal size to the inner diameter dimension of the date wheel 21.

Configuration of the Solar Cell Holding Member

A solar cell holding member 45 is fixed to the back surface of the solar cell 4. The solar cell holding member 45 is constituted of a stainless steel plate or a plastic plate, and is formed in a substantially disc shape. The solar cell holding member 45 is bonded to the base material 41 of the solar cell 4 using an adhesive agent or adhesive tape. The solar cell holding member 45 is formed to be slightly smaller in size than the solar cell 4, and the entirety thereof is covered by the base material 41 of the solar cell 4. For this reason, the solar cell holding member 45 will not be exposed from the solar cell 4 and will not be visible from the character plate 5 side.

The solar cell holding member 45, when mounted onto the ground plate 20, is arranged above the drive teeth 211 of the date wheel 21 (on the character plate 5 side) and is also provided with a function for positioning so as to prevent the date wheel 21 from moving toward the character plate 5 side. More specifically, the solar cell holding member 45 functions like a date wheel holder for positioning the date wheel 21 in the cross-section direction (the timepiece thickness direction).

Figure 4:
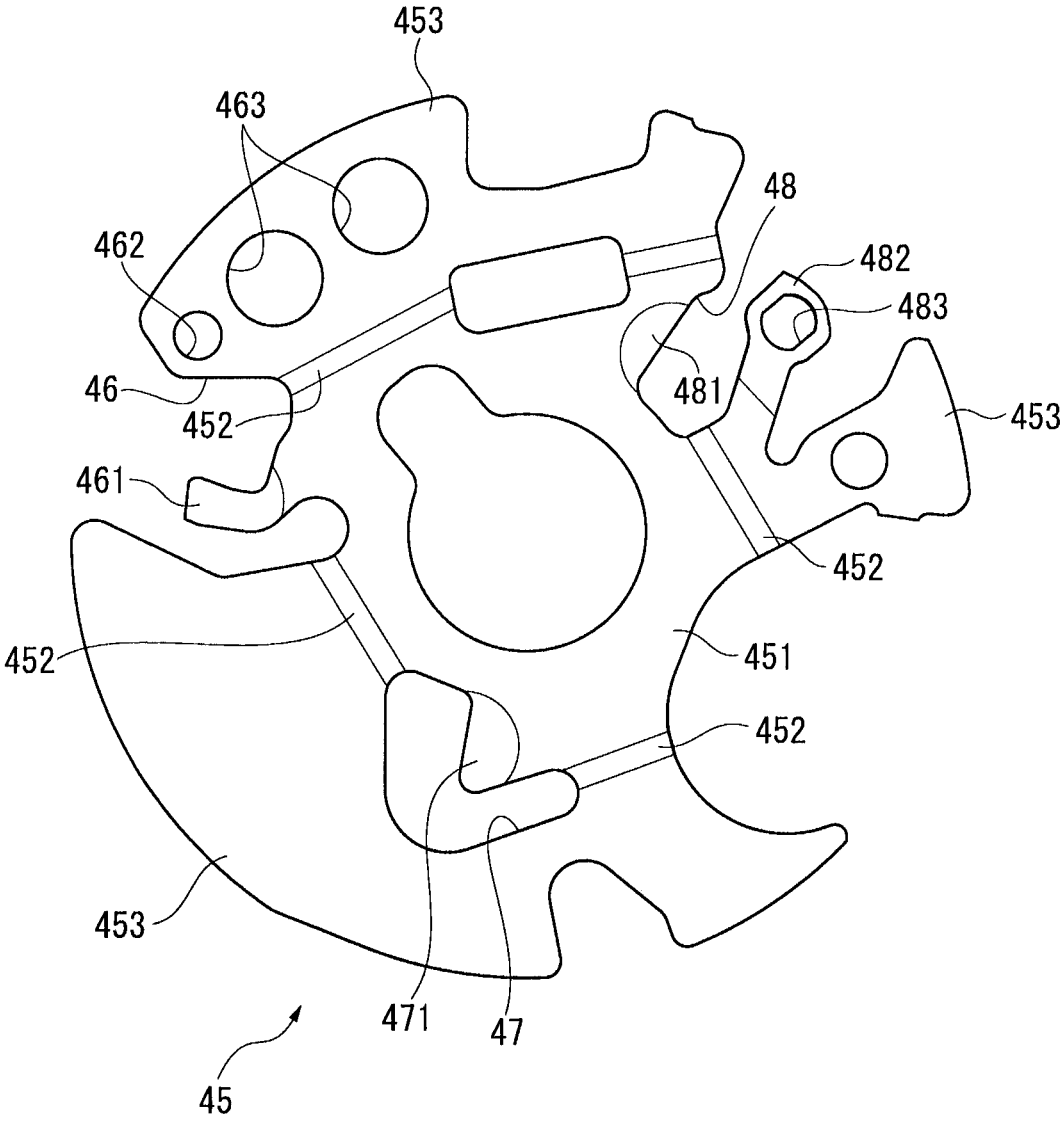
FIG. 4 is a plan view illustrating a solar cell holding member of the electronic timepiece with a solar cell.

The solar cell holding member 45, as is also illustrated in FIG. 4, is provided with three guide holes 46, 47, 48 corresponding to the hook parts 25, 26, 27. The guide holes 46, 48 are given a groove shape communicating to the outer periphery of the solar cell holding member 45. The guide holes 46, 47, 48 are formed so as to allow the hook parts 25, 26, 27 to be arranged in the respective holes thereof. More specifically, the size and/or formation position of the guide holes 46, 47, 48 is set in accordance with that of the hook parts 25, 26, 27.

As is also illustrated in FIG. 2, an outer peripheral part 453 coupled to a center part 451 of the solar cell holding member 45 via a bent part 452 has a height position (position in the timepiece thickness direction) located closer to the character plate 5 than the center part 451, due to the fact that the bent part 452 has been bent. The outer peripheral part 453 is arranged above the drive teeth 211 of the date wheel 21 and carries out positioning of the date wheel 21.

Locking parts 461, 471, 481 which are locked onto the hook parts 25, 26, 27 are formed on a portion of the center part 451 facing each of the guide holes 46, 47, 48. These locking parts 461, 471, 481 are formed one step lower than the center part 451 toward the movement 2.

A positioning part 482 extended out from the outer peripheral part 453 is formed on the guide hole 48. A hole 483 for engaging with one of the two positioning projections 28 is formed on the positioning part 482.

A hole 462 serving as a positioning part for engaging with one of the two positioning projections 28 and two insertion holes 463 into which the conduction spring 7 is to be inserted are all formed on the outer peripheral part 453 provided between the guide holes 46, 48, i.e., on an inner peripheral side of the date wheel 21. The conduction spring 7 is therefore arranged on the inside of the date wheel 21 when in plan view seen from the character plate 5 side. The hole 462 and the insertion hole 463 are arranged at positions that are adjacent on the inside of the date wheel 21. The insertion hole 463 is formed to a size that does not come into contact with the conduction spring 7. A configuration can also be adopted such that an insulating member is arranged on an inner peripheral surface of the insertion hole 463 to prevent electricity from being conducted even when there is contact with the conduction spring 7. Electrodes electrically connected to the conduction spring 7 are therefore formed at positions corresponding to the insertion holes 463 of the solar cell holding member 45 on the back surface of the base material 41 of the solar cell 4. Also, as illustrated in FIG. 3, an electrode on a circuit board 8 side electrically connected to the conduction spring 7 is formed also at positions corresponding to the insertion holes 225 of the ground plate 20 in the circuit board 8 arranged on the back lid side of the ground plate 20. The circuit board 8 is mounted onto the ground plate 20 by a circuit-pressing plate 9. The solar cell holding member 45 is bonded to the base material 41 of the solar cell 4 at a portion where the outer peripheral part 453 is.

Configuration of the Character Plate

The character plate 5 is formed of a light-transmitting material to a size that covers the entirety of the light-receiving unit 42 of the solar cell 4, as illustrated in FIGS. 1 and 2. The character plate 5 can be of a size that covers at least the entirety of the light-receiving unit 42, or can be of a size greater than that of the character plate-receiving ring member 3. The character plate 5 is provided with four extension parts 51 extending out from the outer peripheral edge in the radial direction, as well as with two first engagement parts 52 formed by making a cut into each of the extension parts 51 in the shape of a "U" in plan view, and two second engagement parts 53 formed by making a cut in a semi-circular shape in plan view.

At least the extension parts 51 are placed on top of a top surface 30 of the character plate-receiving ring member 3, whereby the character plate 5 is supported by the character plate-receiving ring 3. The first engagement parts 52 are fitted into first character plate fixation parts 33, and the second engagement parts 53 are fitted into second character plate fixation parts 34. The character plate 5 is thereby positioned and fixed in the direction of rotation with respect to the character plate-receiving ring member 3. The calendar window 55, from which the date wheel 21 is exposed, is formed on the character plate 5.

Assembly of the Timepiece Main Body

A method for assembling the timepiece main body 10 shall now be described. Firstly, the movement 2 is held with the character plate-receiving ring member 3. At this time, the character plate-receiving ring member 3 is inserted in from above the movement 2, and is supported such that the support hook parts of the character plate-receiving ring member 3 are hooked onto the base surface of the movement 2. Depending on the size of the timepiece case, a frame (not shown) is also mounted onto the movement 2.

Figure 5:
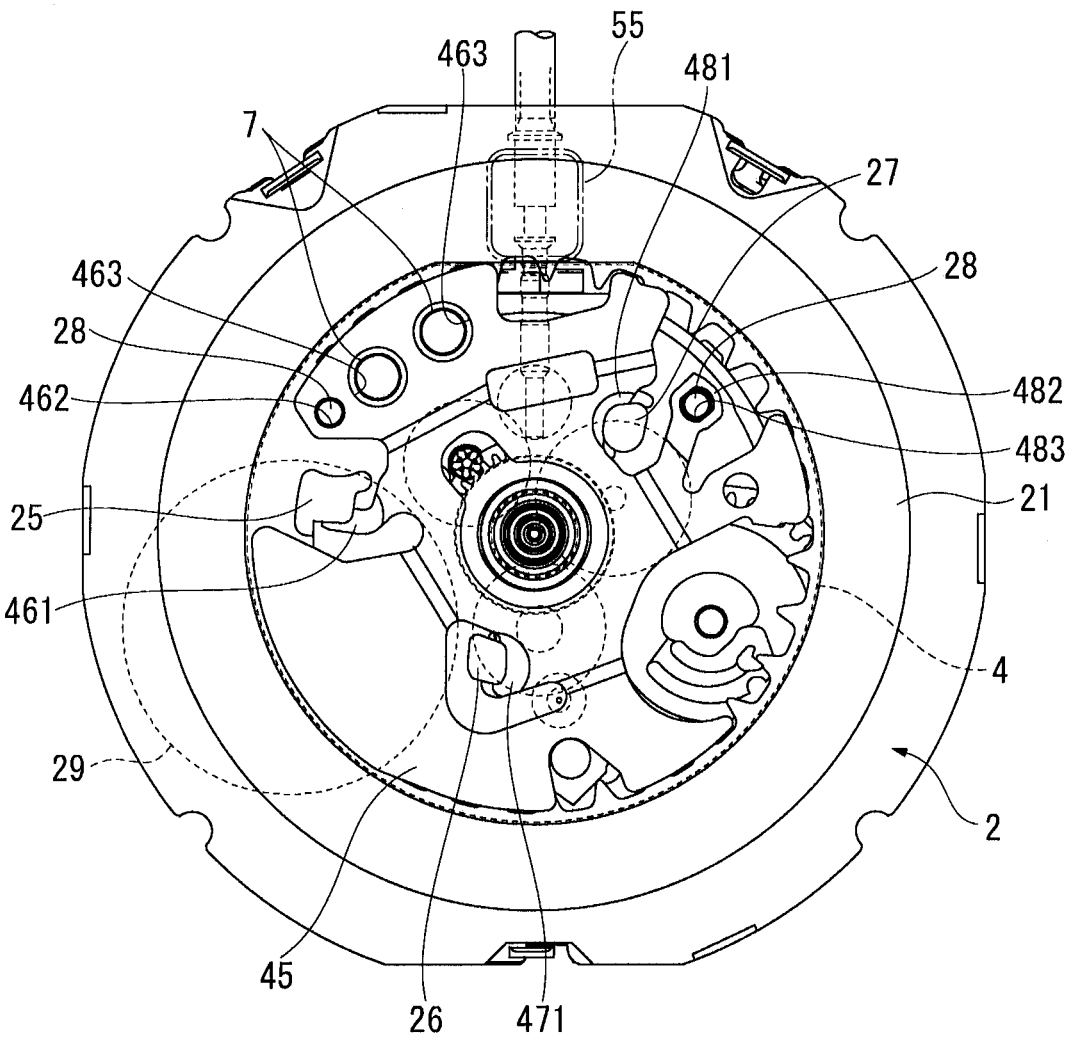
FIG. 5 is a plan view illustrating a mounted state of a movement onto the solar cell holding member.

Next, the solar cell 4 is mounted onto the movement 2 by the following procedure. Firstly, the conduction spring 7 is arranged in the insertion holes 225 of the ground plate 20. Next, the hook parts 25, 26, 27 are arranged on the inside of the guide holes 46, 47, 48 of the solar cell holding member 45, which has been bonded to the back surface of the solar cell 4. Then, together with the solar cell 4, the solar cell holding member 45 is rotated clockwise while also being pushed in on the movement 2 side, and the locking parts 461, 471, 481 are locked into the hook parts 25, 26, 27 as illustrated in FIG. 5. The solar cell 4 and the solar cell holding member 45 are thereby mounted onto the ground plate 20 positioned in the timepiece thickness direction. The hole 483 of the positioning part 482 of the solar cell holding member 45 as well as the hole 462 formed on the outer peripheral part 453 are both engaged with the positioning projection 28, and the solar cell holding member 45 is positioned in the direction of rotation. At this time, the conduction spring 7 is brought into contact with an electrode formed on the back surface of the solar cell 4 and with an electrode of the circuit board 8, and allows conduction through the solar cell 4 and the circuit board 8.

The solar cell 4 and the solar cell holding member 45 are thus fixed to the movement 2, as illustrated in FIG. 5, by the foregoing procedure. Also, the solar cell 4 and the solar cell holding member 45 are positioned with respect to the direction of rotation of the ground plate 20 by the engagement of the holes 462, 483 into the positioning projection 28.

Next, the character plate 5 is held by the character plate-receiving ring member 3 from the front surface side of the solar cell 4. More specifically, the first engagement part 52 is fitted into the first character plate fixation part 33 of the character plate-receiving member 3, and the second engagement part 53 is fitted into the second character plate fixation part 34. The character plate 5 is thereby placed on top of the top surface 30 of the character plate-receiving member 3 and positioned with respect to the thickness direction. Also, the character plate 5 is positioned with respect to the direction of rotation of the character plate-receiving member 3 by the fitting of the engagement part 52, 53 into the character plate fixation parts 33, 34. The foregoing is the manner in which the timepiece main body 10 is assembled.

According to the electronic timepiece 1 with a solar cell as in the embodiment described above, the following effects are achieved.

(1) Because the conduction spring 7 electrically connecting the solar cell 4 and the circuit board 8 is arranged in a space on the inside of the date wheel 21, the movement 2 can be reduced in size in comparison to a case where the conduction spring is provided to the outside of the date wheel 21. For this reason, an electronic timepiece with a solar cell for use by women, too, can be easily designed and manufactured. Also, because there is no interference from the conduction spring 7 even when the outer diameter dimensions of the date wheel are large, there is no need to change the electrode position of the solar cell 4 nor the arrangement position of the conduction spring 7 when a model having a large outer diameter of the date wheel 21 is developed as the electronic timepiece 1 with a solar cell. For this reason, a movement 2 that includes the solar cell 4, the conduction spring 7, and the circuit board 8 can be created to be shared among a variety of models in which the outer diameter dimension of the date wheel 21 is different, and also costs can be reduced. Also, the distance between the date wheel 21 and the timepiece outer periphery (the outer case) can be reduced in comparison to the case where the conduction spring 7 is provided to the outside of the date wheel 21. For this reason, the degree of freedom in the position of the calendar window 55 formed in the character plate 5 is improved, and the degree of freedom in the design variation of the character plate 5 can be improved.

(2) The hook parts 25, 26, 27 are formed on the upper surface of the ground plate 20 of the movement 2, the guide holes 46, 47, 48 having the locking parts 461, 471, 481 are formed on the solar cell holding member 45 bonded to the back surface of the solar cell 4, and the locking parts 461, 471, 481 are locked onto the hook parts 25, 26, 27 to mount the solar cell 4 onto the movement 2. For this reason, the position of fixation of the solar cell 4 and the solar cell holding member 45 to the ground plate 20 can be designed to be close to the arrangement position of the conduction spring 7. As such, even when a pressing force is applied to the electrode of the solar cell 4 by the conduction spring 7, the pressing force can be borne by the locking structure of the hook parts 25, 26, 27 and the guide holes 46, 47, 48. As such, the solar cell 4 can be prevented from majorly deforming due to the pressing force of the solar cell 7, even in a case where the base material is made using a film solar panel made of a plastic film as the solar cell 4.

(3) Because there is no need to provide a hook part to the outer periphery of the solar cell holding member 45, the hook parts will not protrude from the outer periphery of the solar cell 4 and will not be seen from through the character plate 5. As such, there is no need to arrange a visual limiting member for covering the solar cell holding member 45, and any constraint of the visual limiting diameter can also be eliminated. Accordingly, the degree of freedom of the size of the character plate 5 and the size of the visual limiting diameter can be increased, and in a case where the electronic timepiece 1 with a solar cell is to be configured as a wristwatch, then the degree of freedom of model variation can also be increased, from a large-sized wristwatch having a large visual limiting diameter to a wristwatch for use by women, having a small visual limiting diameter.

(4) Because the solar cell 4 can be fixed in the vicinity of the center of the ground plate 20, i.e., of the movement 2, the size of the solar cell 4 can be freely set within the size of the movement 2. For this reason, the size of the solar cell 4 can be set to a minimum size on the basis of the amount of power generation required even in a case where the size of the movement is different 2. As such, the size of the solar cell 4 need not be increased in accordance with the size of the movement 2, and the cost of the solar cell 4 can thus also be reduced. Also, in the fixation between the solar cell holding member 45 and the ground plate 20, because the solar cell holding member 45 is rotated with the hook parts 25, 26, 27 arranged in the guide holes 46, 47, 48 to lock the locking parts 461, 471, 481 on the peripheral edges of the guide holes 46, 47, 48 onto the hook parts 25, 26, 27, there is no need for fixation using a separate screw or other connecting component. For this reason, in comparison to a case where the solar cell 4 is fixed to the ground plate 20 with a screw, the number of components can be lowered and costs can be reduced; because consideration also need not be given to interference with a component arranged on the back surface side of the ground plate 20, the electronic timepiece 1 with a solar cell can be easily designed.

(5) Because the solar cell holding member 45 is provided with the holes 462, 483 for engaging with the positioning projection 28 formed on the ground plate 20, the solar cell holding member 45 can be rotated with respect to the ground plate 20 to prevent the locking parts 461, 471, 481 from falling out of the hook parts 25, 26, 27. Also, because the hole 462 and the insertion hole 463 into which the conduction spring 7 is inserted are arranged so as to be adjacent to each other, the solar cell holding member 45 and the conduction spring 7 are easily removable. More specifically, because the hole 462, which is a positioning part for engaging with the positioning projection 28 is provided close to the conduction spring 7, the conduction spring 7 can be pushed in at the same time as when the portion of the outer peripheral part 453 where the hole 462 is formed is being pushed in. As such, in comparison to a case where the positioning part and the conduction spring 7 are arranged at positions spaced apart from each other, the conduction spring 7 can be more reliably pushed in and the solar cell holding member 45 can be more easily mounted. Also, when the hole 462, which is a positioning part of the solar cell holding member 45, is to be removed from the positioning projection 28, too, then this can be done while the conduction spring 7 near thereto is being pressed, and the solar cell holding member 45 can also be easily removed.

(6) Because the solar cell 4 is set to substantially an equivalent size to that of the solar cell holding member 45, the surface area of the solar cell 4 can be reduced and the cost of the solar cell 4 can be lowered.

(7) Because the solar cell 4 and the character plate 5 can be arranged in a stacked fashion without any spacing therebetween, the electronic timepiece 1 with a solar cell can be reduced in thickness and the impression of a recessed setting of the date wheel 21 can also be attenuated in comparison to a case where, for example, a structure is adopted in which a solar cell holder is provided fixed between the solar cell 4 and the character plate 5.

(8) Because the solar cell 4 and the solar cell holding member 45 are fixed using an adhesive agent or adhesive tape, there will be no exposure of a connecting component on the surface of the solar cell, and a decline in the outer appearance of the electronic timepiece 1 with a solar cell can be prevented in comparison to a case where a connection component such as a screw is used for fixation.

(9) Because the solar cell holding member 45 doubles as a component for positioning the date wheel 21 in a cross-sectional manner, i.e., in the timepiece thickness direction, the number of components can be reduced and the procedure for incorporating same can also be reduced, and thus costs can be lowered. Also, the thickness dimension of the movement 2 can be reduced in comparison to a case where both the solar cell holding member 45 and a component for positioning the date wheel 21 are used.

(10) Because the solar cell holding member 45, bonded to the back surface of the solar cell 4, can be constituted of a metal such as stainless steel, the solar cell holding member functions not only to mount the solar cell 4 onto the ground plate 20, but also to enhance the strength of the solar cell 4 itself. As such, a film made of a synthetic resin or the like can be used as the base material 41 of the solar cell 4, and the solar cell 4 can be reduced in thickness and reduced in cost.

(11) Because the color of the front surface side of the character plate-receiving ring member 3 can be made to be the same type of color as the solar cell 4, the color tones of the solar cell 4 and the character plate-receiving ring member 3 can be matched together. For this reason, a difference in the color tone with respect to the character plate-receiving ring member 3 can be prevented from causing the outer form of the solar cell 4 to be visible seen through the character plate 5, and the outer appearance of the timepiece when seen through the character plate 5 can be enhanced.

Modifications of the Embodiment

The invention is not to be limited to the above-described embodiment, but rather any modification, improvement, or the like made within a scope capable of achieving the advantage of the invention is intended to be included within the invention. The size of the solar cell 4 is not limited to the size in the above-described embodiment. More specifically, any size is permissible, provided that adequate power needed to drive the movement 2 can be ensured. Herein, when the outer diameter of the solar cell 4 is formed to be smaller than the inner diameter of the date wheel 21, then the solar cell 4 and the date wheel 21 can be arranged at the same height position (the same positioning in the thickness direction of the timepiece). In such a case, the thickness dimension of the electronic timepiece 1 with a solar cell can be reduced and a thinner timepiece can be achieved, in comparison to a case where the solar cell 4 and the date wheel 21 are arranged at different height positions.

The upper surface position of the date wheel 21, i.e., the height position in the timepiece thickness direction can be arranged to be above the lower surface of the solar cell 4. In such a case, the distance between the date wheel 21 and the character plate 5, arranged atop the solar cell 4, can be reduced. For this reason, the impression of a recessed setting of the date wheel 21 which can be viewed from the calendar window 55 of the character plate 5 can be attenuated, and the date and the like can also be more easily read.

In the above-described embodiment, the character plate-receiving ring member 3 that was used was annular, but a character plate-receiving ring member having a planar rectangular frame shape can also be used. When a character plate-receiving ring member of such description is used, the character plate or timepiece case can constitute a rectangular model.

In the above-described embodiment, the hook parts 25, 26, 27 were formed on the ground plate 20 side, and the guide holes 46, 47, 48 were formed on the solar cell holding member 45 side, but conversely, the guide holes can be formed on the ground plate 20 side and the hook parts can be formed on the solar cell holding member 45 side.

In the above-described embodiment, the solar cell holding member 45 was fixed to the back surface of the solar cell 4 with an adhesive agent or adhesive tape, but other methods of fixation can be used to fix same. For example, in a case where the base material 41 of the solar cell 4 is a metal plate, then the solar cell holding member 45 can be fixed with swaging or the like.

In the above-described embodiment, the solar cell holding member 45 doubled as a member for positioning the date wheel 21 in the timepiece thickness direction, but the positioning of the date wheel 21 in the timepiece thickness direction can also be carried out with another component. Also, although the date wheel 21 was provided as a calendar wheel, a day-of-the-week wheel or other calendar wheel can also be arranged. Furthermore, because the conduction spring 7 is arranged in a space on the inside of the calendar wheel and the arrangement space of the calendar wheel is easily expanded toward the outer periphery, there can be two types of calendar wheels, such as the date wheel 21 and a day-of-the-week wheel, arranged therein.

In the above-described embodiment, the color the character plate-receiving member 3 was the same type of color as that of the solar cell 4, but these can also be of different colors. In particular in a case where an exposed surface of the character plate-receiving member 3 is covered by a dial ring or other visual limiting member, there is no need for the color of the character plate-receiving ring member 3 to be matched to that of the solar cell 4. In the above-described embodiment, a timepiece of the wristwatch type was described as an example of the timepiece according to the invention, but there is no limitation thereto, and a wall-hanging clock or other type of timepiece is also possible.

What is claimed is:

1. An electronic timepiece with a solar cell, the timepiece comprising:

a hand configured to show time;

an axis connected to the hand to rotate the hand, the axis extends in a direction;

a solar cell;

a light-transmissive character plate arranged on a timepiece front side of the solar cell;

a ground plate arranged on a back surface of the solar cell;

a ring-shaped calendar wheel disposed between the character plate and the ground plate; and a circuit board having a conduction spring, and electrically connected to an electrode of the solar cell via the conduction spring, the conduction spring being arranged on the inside of the calendar wheel in plan view seen in the direction.

2. The electronic timepiece with a solar cell as set forth in claim 1, further comprising:

a solar cell holding member fixed to the back surface of the solar cell, the solar cell holding member and the ground plate each having opposing surfaces provided to the inside of the calendar wheel in the plan view seen in the direction, a hook part being formed on one of the opposing surfaces and a guide hole formed to allow for the hook part to be arranged being formed on the other of the opposing surfaces, and the solar cell holding member being rotated with respect to the ground plate in a state where the hook part has been arranged within the guide hole to lock a peripheral edge of the guide hole onto the hook part, whereby the solar cell holding member is fixed to the ground plate.

3. The electronic timepiece with a solar cell as set forth in claim 2, wherein the solar cell holding member comprises:

a positioning part for engaging with a positioning projection formed in the ground plate to carry out positioning in a direction of rotation, as well as an insertion hole into which the conduction coil is inserted, the positioning part and the insertion hole being arranged so as to be adjacent to each other.

4. The electronic timepiece with a solar cell as set forth in claim 1, wherein the solar cell is arranged on the inside of the calendar wheel in the plan view seen in the direction.

5. The electronic timepiece with a solar cell as set forth in claim 4, wherein the height position of an upper surface of the calendar wheel in the thickness direction of the timepiece is positioned above a lower surface of the solar cell.

* * * * *